United States Patent [19]

Nolan et al.

[11] 4,344,491

[45] Aug. 17, 1982

[54] APPARATUS FOR ACTUATING DOWNHOLE FLOW CONTROL VALVES

[75] Inventors: James J. Nolan, Brielle; John E. Coakley, Westfield, both of N.J.

[73] Assignee: Slurry Mining Engineering Inc., Westfield, N.J.

[21] Appl. No.: 282,913

[22] Filed: Jul. 13, 1981

Related U.S. Application Data

[62] Division of Ser. No. 136,283, Apr. 1, 1980.

[51] Int. Cl.[3] ..... E21C 45/00

[52] U.S. Cl. ..... 175/317; 137/505.24; 299/17

[58] Field of Search ..... 299/17; 175/67, 213, 175/215, 242, 317; 137/505.22, 505.24

[56] References Cited

U.S. PATENT DOCUMENTS

| | | | |
|---|---|---|---|
| 1,110,294 | 9/1914 | Osmer | 137/505.24 |
| 3,155,177 | 11/1964 | Fly | 299/17 |
| 3,316,985 | 5/1967 | Fly | 299/17 |
| 3,730,592 | 5/1973 | Wenneborg et al. | 299/17 |
| 3,747,696 | 7/1973 | Wenneborg et al. | 299/17 |
| 4,035,023 | 7/1975 | Cockrell | 299/17 |
| 4,059,166 | 11/1977 | Bunnelle | 299/17 |
| 4,067,617 | 1/1978 | Bunnelle | 299/17 |
| 4,077,481 | 3/1978 | Bunnelle | 299/17 |
| 4,077,671 | 3/1978 | Bunnelle | 299/17 |
| 4,134,619 | 1/1979 | Bunnelle | 175/215 X |

*Primary Examiner*—Ernest R. Purser
*Attorney, Agent, or Firm*—John E. Coakley

[57] ABSTRACT

A method and apparatus is provided for actuating downhole flow control valves in a borehole mining tool to change the tool function from drilling to mining while still in the borehole. Self-activating actuators employing only system pump pressure control the flow of fluid to the drill bit, the mining jet, the discharge eductor or eductors and are located within the discharge conduit or in a compartment in the tool to change the function of the operative components. The valve actuator can actuate more than one valve simultaneously.

4 Claims, 1 Drawing Figure

APPARATUS FOR ACTUATING DOWNHOLE FLOW CONTROL VALVES

This is a division of application Ser. No. 136,283 filed Apr. 1, 1980 and is assigned to the assignee of that invention.

BACKGROUND OF THE INVENTION

1. Field of the Invention

This invention pertains to improvements in downhole flow control valve actuation and particularly to a method and an apparatus for actuating valves using the changes in fluid pressure within the tool string to change the valve positions from drilling to mining while in the borehole.

2. Description of the Prior Art

Hydraulic borehole mining of ore is broadly known in the art as evidenced by the following United States Patents:

U.S. Pat. Nos. 3,155,177 and 3,316,985 issued to A. B. Fly on Nov. 3, 1964 and May 2, 1967 respectively teach a method and apparatus for slurry mining through a borehole which may be changed between its drilling mode of operation and its mining mode of operation to mine several different strata without removing the tool from the borehole. The drill string is equipped with a conventional drill bit enabling the machine to drill through hard formations; the drill bit being driven by a hydraulic drilling device. The invention teaches the essential controls needed to convert from drilling to mining, i.e., mining nozzle flow, eductor nozzle flow and fluid flow to the drill bit each with a drilling mode and a mining mode of operation. Electric motors within the tool string operate the valves to convert the apparatus from the drilling mode to the mining mode of operation while the tool is still in the borehole.

U.S. Pat. Nos. 3,730,592 issued May 1, 1973 and 3,747,696 issued July 24, 1973 to Wenneborg et al discloses a method and apparatus for borehole mining wherein a hydraulic actuating force for changing the function of the tool from drilling to mining is transmitted from the surface and the actuating fluid line is located wholly within the fluid supply passage to the lower tool section; the hydraulic valve operating means is used to operate the mining nozzle, foot valve and a slurry eductor located at the base of the tool.

U.S. Pat. No. 4,035,023 filed July 15, 1975 and issued July 12, 1977 to Clifford Cockrell discloses the use of a rotatable concentric dual-conduit tool string with Hydril type screwed joints wherein fluid is directed down the annular space between the conduits and the slurry is returned to the surface through the inner conduit. The cavity is subjected to air pressure sufficient to raise the slurry to the surface via the slurry discharge conduit. A foot valve controls the volume of slurry rising to the surface and is hydraulically operated by the differential pressure the vented cavity pressure at the base of the tool and the hydraulic pressure supplied by a slurry level controller.

In this disclosure Cockrell is the first to teach a principle of self-activating down-hole hydraulic valves for tool control; he is first to disclose, describe and use the differential pressure between a control pressure equivalent to or less than system pressure and the vented cavity pressure to establish a hydraulic actuating force for down-hole hydraulic valve control. Cockrell is also first to teach, describe and use the differential hydraulic actuating force between a control pressure and the cavity pressure to modulate down-hole control valves.

U.S. Pat. No. 4,059,166 of Nov. 22, 1977 and No. 4,067,617 of Jan. 10, 1978 issued to P. R. Bunnelle disclose a apparatus for slurry mining wherein several different hydraulic control systems are disclosed to convert the down-hole tool from drilling to mining all with valve control means located within the fluid supply passage of the tool. A control system employing a conduit extending to the surface is used to hydraulically modulate the eductor nozzle to control the cavity pressure; control systems activated by the difference between the pump pressure and a vented or cavity pressure are also employed. Self-activating systems to modulate the eductor nozzle also employ the pressure difference between a control pressure and a vented cavity pressure for valve actuation. Seperate control systems are employed for the eductor and the foot valve. An important feature of these systems is that the valve actuating control pressure and the drilling pressure are the same during drilling while during mining the valve actuating control pressure is established by venting to the cavity pressure or to the atmosphere.

U.S. Pat. No. 4,077,671 of Mar. 7, 1978 and No. 4,077,481 of Mar. 7, 1978 issued to P. R. Bunnelle discloses a modified valve control system which is self-activating by responding to the pressure differential between the system pressure and the pressure in the well cavity. In this disclosure the valve control means is responsive to fluid pressure differences; the control means having a system pressure end and a vented "control end". The mining nozzle includes a mining nozzle, seat and a mining nozzle cylinder slideable receiving the nozzle plug which receives system pressure at a system end and a control pressure at a control end. The eductor nozzle cylinder and foot valve also have a control end which is "vented" during mining. Venting to the atmosphere is also used as a control means. A "vented" control fluid is supplied for selectively opening or closing valves which acts in opposition to the fluid at system pressure on the control means to change the tool function. The salient feature of this method is that during the drilling mode the valve actuating control pressure and the drilling pressure are the same while during mining the valve actuating control pressure is established by venting to the cavity pressure or to the atmosphere.

SUMMARY OF THE INVENTION

The present invention provides a method and apparatus for actuating downhole fluid flow control valves to change the tool from drilling to mining while still in the borehole. The hydraulic actuating force is provided by the fluid pressure pumped into the tool string.

In hydraulic borehole mining the drilling operation is usually carried out using drilling fluid pressures which vary from approx. 200 p.s.i.g. to 350 p.s.i.g. During mining the fluid pressure is increased to approx. 800 p.s.i.g. or higher for specific mining applications. When deep wells are drilled it is desirable to have multiple eductor pumps to raise the ore to the surface. These eductors might be 50 to 250 ft. or more apart; it would be impractical to have control conduits run to these locations to actuate the valves. It is an object of this invention to provide self-activating valves utilizing the increase in pressure from drilling to mining to activate the valves.

Our method employs a piston-cylinder actuator with an oversized piston rod and incorporating a stop within the cylinder to control the length of travel of the piston and a spring within the cylinder strong enough to retain the piston at the head end of the cylinder during the application of drilling pressure to both ends of the cylinder.

Pump pressure is applied to both ends of the cylinder from a connection upstream of the valve. A conduit between the cylinder ends contains a metering orifice to control the rate of movement of the piston rod to slowly actuate the valve to minimize water-hammer in the system. If equal pressure is imposed on each end of a piston-cylinder actuator, the piston will be forced toward the rod end due to the differential area of pressure across the piston; the differential area being caused by the reduction in the area of pressure on the rod end due to the rod extending through the cylinder. During drilling when the system pressure is approx. 300 lb.per sq.in., the piston is held at the head end of the cylinder by the spring; when higher mining system pressure is applied to both ends of the cylinder the piston is forced toward the rod end against the stop overcomming the spring force and actuating the valve. Only the pump pressure is applied to actuate the valve.

The head end of the cylinder is pivot mounted to a structural support to permit arcuate movement of the actuating rod. The piston rod is pivotally connected to the valve handle in the normal position of the valve. The position of the stop within the cylinder permits ninety degrees of rotation of the valve handle. An actuator of this type can be used on the drilling water valve, mining nozzles and eductors; the normal position of the valves—open or closed—being preset to accommodate its operating function.

The control valve actuators are located within the discharge conduit of the tool string and only the pressures in this conduit are applied externally to the actuator. The valve actuator could, however, be mounted in a separate compartment subject only to the pressures within this compartment. It will be understood that the control valve actuators used on the downhole valves could be made to function with the rod end of the cylinder vented to the pressure within the discharge conduit with a filter in the vent line and with the supply fluid pressure applied to the head end of the cylinder with an orifice in the conduit to control the velocity of valve actuation and with the normal position of the valve being maintained by the spring during the application of drilling system pressure to the head end of the cylinder and with the mining system pressure forcing the piston to the stop actuating the valve. It will be further understood that the actuator could also be utilized with a spring at the head end of the cylinder and mining pressure applied to the rod end while venting the head end to the pressures in the discharge conduit.

The self-activating valve operators are capable of operating the flow control valves of the drilling and mining apparatus using only system pressure without withdrawing the tool string from the borehole. Although the preferred mode has been described, it will be apparent that modification and variation may be made without departing from what is regarded as the subject matter of this invention.

It will be understood that one of these valve actuators can be used to actuate more than one valve.

DESCRIPTION OF THE PREFERRED EMBODIMENT

Figure 1:
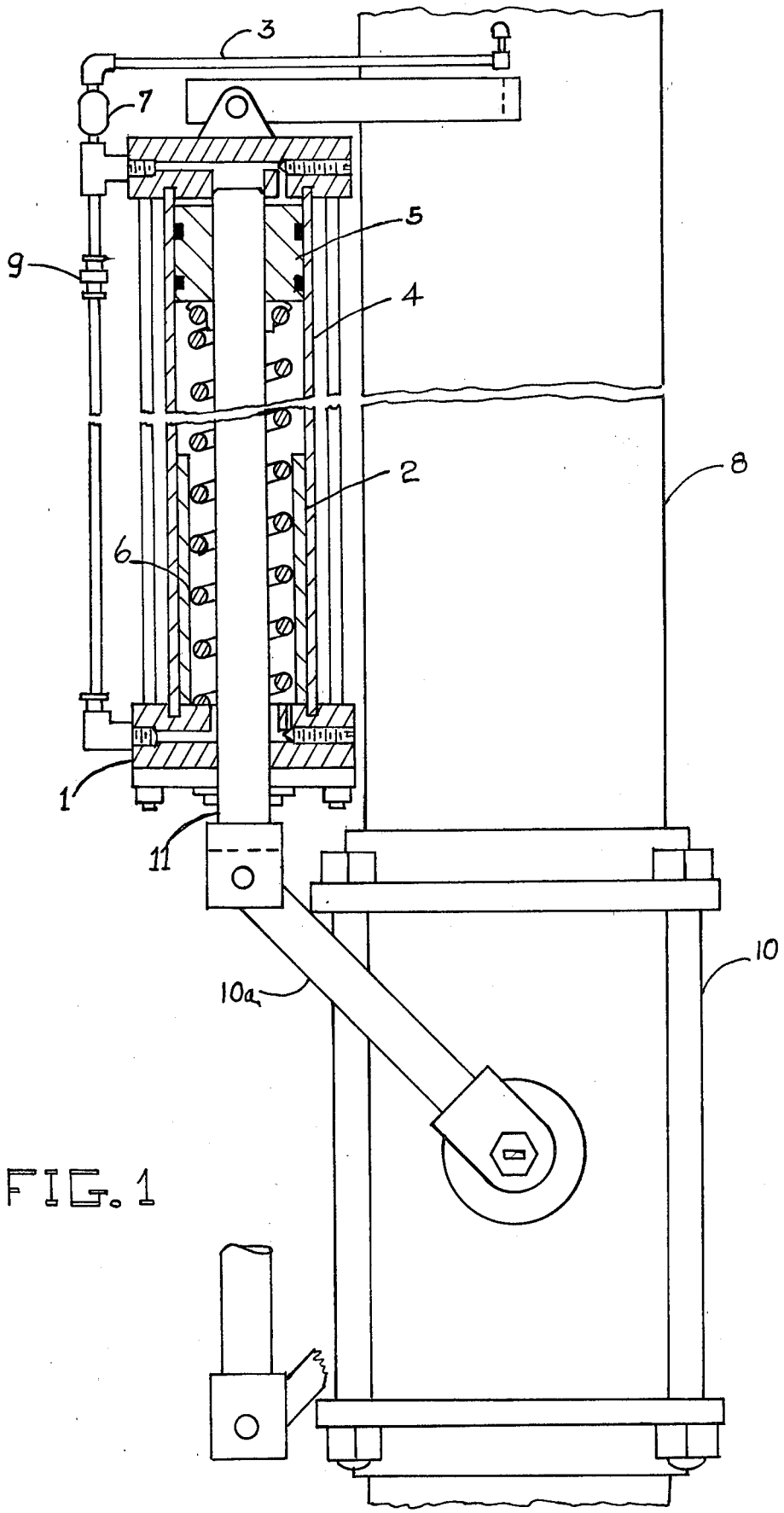
FIG. 1 is a view in elevation of a typical control valve and valve actuator with a sectional view of the valve actuator to illustrate the location of the piston stop and resilient within the cylinder and also the piping arrangement supplying pump pressure to both ends of the actuator cylinder with a metering orifice in the piping between the cylinder ends.

FIG. 1 is a typical arrangement of a piston-cylinder valve actuator. System pressure or pump pressure from a supply conduit is directed into a conduit 3 connected to both ends of the cylinder actuator 4 applying equal fluid pressure to both sides of the piston 5. A filter 7 (optional) is installed in the conduit 3 to provide clean fluid (water) entering the actuator. The valve control handle 10*a* is connected to the valve stem in the normal operating position of the valve 10 when the piston 5 is held in the retracted or normal position within the cylinder by the spring 6 when pressure is not imposed on either side of the piston 5. During drilling when the pressure is usually 200 to 350 p.s.i.g. the piston 5 is held in the retracted position within the cylinder 4 by the spring 6 which overcomes the hydraulic force tending to drive the piston toward the rod end of the cylinder. When high mining pressure—800 p.s.i.g. and above—is imposed on both ends of the valve actuator cylinder 4 the piston 5 is urged or forced toward the stop 2 by the increased force driving the piston 5 toward the rod end of the cylinder by the differential area of pressure across the piston 5; the differential area being caused by the reduction in area on the rod end due to the area of the rod 11 which has only the pressure in the inner conduit acting on the area of the piston rod. The conduit between the cylinder ends a metering orifice 9 to control the rate of movement of the piston to slowly actuate the valve and reduce water hammer in the system.

I claim:

1. An apparatus for actuating downhole flow control valves in the discharge conduit of a borehole mining tool with a hydraulic power cylinder actuated by the fluid supply pressure to the mining tool comprising:

(a) a control or lever arm attached to the valve stem of a flow control valve in its normal position in a fluid supply conduit;

(b) a hydraulic power cylinder with a piston within the cylinder and a piston rod attached thereto and extending through the cylinder and pivotally attached to the flow control valve arm or lever while the head end of the cylinder is pivotally attached to a structural support to permit arcuate movement of the control valve lever arm;

(c) a spring within the cylinder at the rod end and holding the piston at the head end when subjecting both ends of the cylinder to drilling pressure;

(d) a piston stop within the rod end of the cylinder to stop movement of the piston after a change in valve position;

(e) piping connecting the fluid supply conduit of the drill string to each end of the actuating cylinder and with the position of the piston being held at the head end of the cylinder by the internal spring which is capable of resisting movement of the piston while drilling system pressure is applied to both ends of the cylinder;

(f) means for increasing the fluid supply pressure to mining system pressure and applying the pressure to each end of the cylinder which forces the piston opposed by the spring against the stop with the piston rod actuating the control valve arm changing the position of the valve.

2. An apparatus according to claim 1 wherein an orifice is installed in the piping between the cylinder ends to control the velocity of movement of the piston within the cylinder to prevent water hammer in the system.

3. An apparatus for actuating downhole flow control valves in a borehole mining tool that is responsive to changes in pressure of a fluid directed into the tool string, which comprises:

(a) a control or lever arm attached to the valve stem of a flow control valve in its normal position;

(b) a hydraulic power cylinder with a piston within the cylinder and a piston rod attached thereto and extending through the cylinder and pivotally attached to the flow control arm or lever of a valve while the head end of the cylinder is pivotally attached to a structural support to permit arcuate movement of the control valve lever;

(c) a spring within the cylinder at the rod end capable of holding the piston at the head end when subjecting the head end of the cylinder to drilling pressure;

(d) a stop within the rod end of the cylinder positioned to allow ninety degrees more or less of travel of the control arm of the valve;

(e) piping connecting the fluid supply conduit of the mining tool to the head end of the cylinder and an outlet from the rod end of the cylinder to the pressures within the discharge conduit of the tool;

(f) means for increasing the hydraulic pressure of the fluid directed into the tool string which is applied to the head end of the cylinder forcing the piston to travel toward the rod end of the cylinder actuating the control valve.

4. An apparatus for actuating downhole flow control valves in a borehole mining tool by a hydraulic power cylinder responsive to changes in pressure of a fluid directed into the tool string, which comprises:

(a) a control or lever arm attached to the valve stem of a flow control valve in its normal position;

(b) a hydraulic power cylinder with a piston within the cylinder and a piston rod attached thereto and extending through the cylinder and pivotally attached to the flow control arm or lever of a valve while the head end of the cylinder is pivotally attached to a structural support to permit arcuate movement of the control valve lever;

(c) a spring within the cylinder at the head end capable of holding the piston at the rod end when subjecting the rod end of the cylinder to drilling pressure;

(d) a stop within the head end of the cylinder permitting the piston to travel sufficiently to change the valve position;

(e) piping connecting the fluid directed into the tool string to the rod end of the cylinder and an outlet from the head end of the cylinder to the pressures within the discharge conduit of the tool;

(f) means for increasing the hydraulic pressure of the fluid directed into the tool string which is applied to the rod end of the cylinder forcing the piston to travel toward the head end of the cylinder actuating the control valve.

* * * * *